United States Patent [19]

Golding et al.

[11] 4,002,273

[45] Jan. 11, 1977

[54] DISPENSE HEAD FOR LIQUID CONTAINERS

[75] Inventors: Cyril George Golding, Sedgley; Eugene Leonowicz, Wolverhampton, both of England

[73] Assignee: GKN Sankey Limited, Telford, England

[22] Filed: Aug. 29, 1975

[21] Appl. No.: 609,027

[30] Foreign Application Priority Data

Sept. 3, 1974 United Kingdom ..... 38364/74

[52] U.S. Cl. ..... 222/400.7

[51] Int. Cl.[2] ..... B65D 83/06

[58] Field of Search ..... 222/400.7

[56] References Cited

UNITED STATES PATENTS

| | | | |
|---|---|---|---|
| 3,065,885 | 11/1962 | Chatten | 222/400.7 |
| 3,353,724 | 11/1967 | Johnson | 222/400.7 |
| 3,632,023 | 1/1972 | Johnson | 222/400.7 |
| 3,687,340 | 8/1972 | De La Hunt | 222/400.7 |
| 3,836,053 | 9/1974 | Johnson | 222/400.7 |

*Primary Examiner*—Allen N. Knowles
*Assistant Examiner*—Hadd Lane
*Attorney, Agent, or Firm*—Woodling, Krost, Granger & Rust

[57] ABSTRACT

The invention is a dispense head for use with a metal beer keg to supply beer under carbon dioxide gas pressure, the keg being of the type having a standard neck fitting including co-axial gas and beer valves operated by insertion of a probe into the neck. The dispense head can be attached to the keg with the probe raised and in this condition a gas shut-off valve closes the gas passageway. This is opened automatically on the lowering of the probe into the neck of the keg which also opens the keg valves. The gas shut-off valve prevents foaming of beer when the dispense head is attached and spraying out of beer dregs when the dispense head is removed from an empty keg.

1 Claim, 1 Drawing Figure

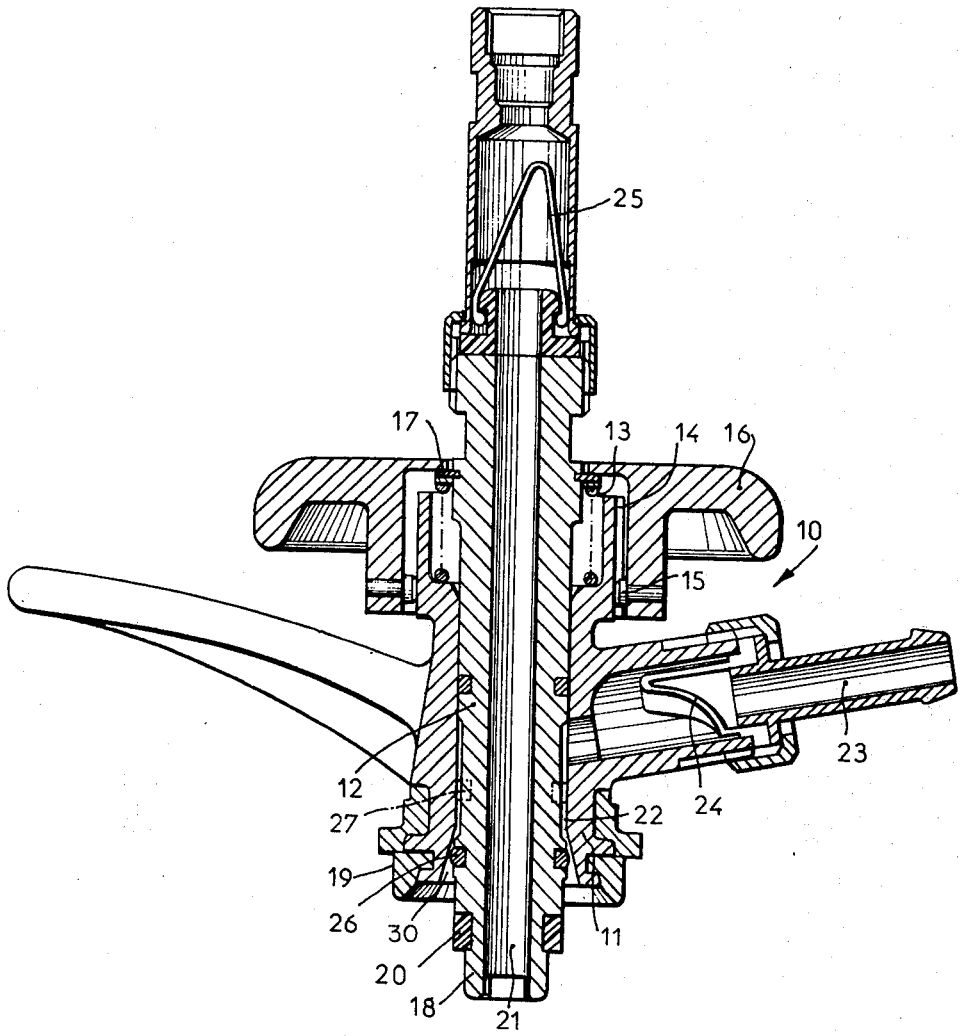
25
17
13
14
16
10
15
23
24
22
12
27
19
26
30
20
18
21
11

DISPENSE HEAD FOR LIQUID CONTAINERS

BACKGROUND OF THE INVENTION

1. Field of the Invention

This invention relates to a dispense head for a liquid container of the type used for dispensing liquid under a pressure derived from a supply of gas, the container having an outlet fitting which includes a pair of co-axially disposed valves controlling the inlet of gas and outlet of liquid respectively, the valves both being openable by the insertion of a probe into the fitting.

The invention has particularly been devised in relation to beer kegs but may be used in connection with other types of liquid container.

2. Description of the Prior Art

It has previously been known to provide a dispense head which includes a probe mounted in the body of the dispense head so as to define a gas passageway and a beer passageway. When the dispense head is being fitted to the keg, the probe enters the outlet fitting at the neck of the keg and opens the concentric beer and gas valves, causing these immediately to communicate with the corresponding beer and gas passageways in the head.

Such arrangements have previously enabled gas from the gas supply to pass into the beer passageway at the centre of the probe during the operation of attaching the dispense head to the keg which has caused the first liquid to be discharged from the keg to be extremely gassy, which is most undesirable in beer.

Furthermore, when such prior dispense head was to be removed from the keg, any dregs of beer which might be lodged in the outlet fitting and adjacent passageways could be sprayed out by the gas supply, to the hazard of the person removing the dispense head.

SUMMARY OF THE INVENTION

It is an object of the invention to provide an improved dispense head overcoming or reducing these disadvantages.

According to the invention there is provided a dispense head for a liquid container of the type used for dispensing liquid under a pressure derived from a supply of gas, the container having an outlet fitting which includes a pair of co-axially disposed valves controlling the inlet of gas and the outlet of liquid respectively, the valves both being openable by the insertion of a probe into the fitting, the dispense head comprising a body adapted to be secured to the container outlet fitting, a probe mounted in the body, the dispense head defining respective passageways for gas and liquid, the probe being selectively movable independently of the fitment of the body to the container between withdrawn and extended positions, and a gas shut-off valve being provided in the gas passageway adapted to close said passageway when the probe is in the withdrawn position and to open it when the probe is in the extended position.

The gas passageway may be defined between the exterior of the probe and the interior surface of the body, the probe having an annular groove defined in its exterior and surrounding the probe, and said gas shut-off valve may comprise an O-ring provided in this groove and co-operable, in the withdrawn position of the probe, with the interior surface of the body to close the gas passageway.

The body may have a counterbore surrounding the probe adjacent its free end and the O-ring may be positioned within the counterbore and spaced from its interior surface when the probe is in the extended position, so as to allow free passage of gas through the gas passageway around the O-ring.

The dispense head may include a manually rotatable member mounted for rotation relative to the body and cam means may be provided between the member and the body so that rotation of the member causes axial movement thereof relative to the body. The probe may be secured to the manually rotatable member so as to rotate and move axially with the member to cause the probe to move between its withdrawn and extended positions.

BRIEF DESCRIPTION OF THE DRAWINGS

The invention will now be described in more detail by way of example only with reference to the accompanying drawing which is a vertical sectional view of a dispense head embodying the invention.

DETAILED DESCRIPTION OF THE PREFERRED EMBODIMENT

The dispense head is generally indicated at 10 and comprises a body 11 within which a probe member 12 is mounted. The probe is capable of limited sliding movement within a bore of the body 11.

The probe is normally urged upwardly by means of a helical coil spring 13 relative to the body 11.

The upper part of the body is provided with a cam track 14 which is helical and on which a pair of studs 15 are allowed to ride. The studs are provided on a manually rotatable wheel 16 and the arrangement is such that rotation of the wheel causes the studs 15 to ride up or down the cam formation 14 and raise and lower the wheel axially relative to the body 11.

The probe is fixed by means of a pair of keys 17 to the wheel 16. Thus, when the wheel 16 is rotated, the probe 12 is also rotated and raised or lowered relative to the body. The probe is shown in its lowermost, fully extended position.

The lower end 18 of the probe acts in generally known manner to open valve means associated with a pair of concentric passageways in the beer keg, which is not shown in the drawings.

Before the dispense head is attached to the keg, the probe is moved into a withdrawn position. The dispense head is presented to the outlet fitting at the neck of the keg and is secured in place so that the portion 19 which is of resilient material forms a seal to the neck of the kegs.

When the dispense head has been fitted, the wheel 16 is then rotated and this causes the probe 12 to be lowered and rotated in the bore of the body 11 until the end portion 18 opens the valves of the keg. A further resilient seal 20 mates up with a corresponding part of the container outlet fitting and defines two separate passages, one being a beer passage which includes the passageway 21 passing up through the centre of the probe, and the other being a concentrically disposed gas passage which includes the gas passageway 22 defined between the exterior surface of the probe and the interior surface of the body.

The gas passageway 22 is connected to a first conduit 23 to which a cylinder of carbon dioxide is connected. This gas acts as a pressurizing medium to force beer from the keg up the beer passageway 21 through suitable pipework to a bar outlet. The carbon dioxide passes downwardly through the gas passageway 22, through one of the concentric passageways in the keg outlet fitting and acts on the surface of the beer in the key causing a pressure which forces the beer up a tube extending from the bottom of the container and connected with the beer passageway 21 via the valve of the outlet fitting. Non-return valves 24 and 25 are provided for gas and beer respectively.

The bore in the body 11 which slidably receives the probe 12 is enlarged at its lower end to provide the gas passageway 22 at a region extending downwardly from the first conduit 23. A conical counterbore 30 is provided at the part of the body surrounding the lower free end of the probe.

The probe has an annular groove near its lower end above the seal 20. An O-ring 26 of resilient material is disposed in the groove to form a gas shut-off valve.

It will be seen that, when the probe is in its extended position as shown in the drawings, the O-ring 26 is disposed within the counterbore 30 of the gas passageway 22. The counterbore is provided to ensure that, when gas is flowing through the gas passageway, the turbulence of the gas as it flows does not force the O-ring 26 out of the annular groove.

When the probe is raised to its withdrawn position by rotation of the wheel 16, for example prior to attaching the dispense head to a keg or removing it from an empty keg, the O-ring 26 is guided inwardly by the counterbore 30 until it lies within the gas passageway 22 and comes into sealing engagement with the interior wall of the bore in the body 11. When the probe is fully withdrawn, the ring 26 adopts the position indicated in chain dotted lines at 27, thus isolating the first conduit 23 from the main body of the gas passage 22. The counterbore thus provides a lead-in which enables the O-ring to be guided into the restricted part of the gas passageway without becoming forced out of the annular groove in which it lies.

During the raising and lowering of the probe, the rotation caused by its being coupled at 17 to the wheel 16 means that there is less tendency for the O-ring to be dragged along the inside of the bore which could cause it to become dislodged or jammed. The probe rotation combined with axial movement tends to assist in preventing loss of the O-ring from its groove.

When the dispense head shown in the drawings is fitted to a fresh beer keg, there is no need to turn off or detach the gas supply from the first conduit 23. The probe is withdrawn by rotation of the wheel 16, the seal 19 is engaged with the outlet fitting at the neck of the keg, and the probe is then lowered which has the double effect of moving the O-ring 26 out of sealing engagement with the wall of the gas passageway and hence opening the gas pasageway in the dispense head, and also of opening the gas and beer valves in the neck of the keg to allow the beer to be dispensed. Since the gas supply 23 is isolated by the valve 26 during the actual fitting of the dispense head to the keg, there is no possibility of excessive amounts of gas getting into the beer passageway 21 or the parts of the outlet fitting surrounding the probe. Hence, when the discharge head is operated to pump beer from the keg, the first quantity of beer drawn off is not excessively gassy and this eliminates the wastage of frothy beer which occurs when a conventional discharge head is used.

A further advantage of the construction shown is that, when it is desired to remove the dispense head from an empty keg, it is not necessary to cut-off the carbon dioxide gas supply to the first conduit 23 because, prior to removing the dispense head, the wheel 16 is rotated to withdraw the probe and this automatically closes off the gas supply within the dispense head, making it impossible for the gas to blow out any traces of beer which may have seeped into the outlet fitting of the keg.

Although the invention has been described with respect to a dispense head having a manually rotatable member such as the wheel 16 to raise and lower the probe, it can also be applied to dispense heads in which the probe is raised and lowered by some other means such as a cam and lever arrangement, which may not cause the probe to rotate during its axial movement. Furthermore the invention is not limited to the particular construction of valve used to shut-off the gas supply in the embodiment described.

We claim:

1. A dispense head for a liquid container of the type used for dispensing liquid under a pressure derived from a supply of gas, the container having an outlet fitting which includes a pair of coaxially disposed valves controlling the inlet of gas and the outlet of liquid respectively, both valves being openable by insertion of a probe into the fitting, the dispense head comprising a body adapted to be secured to the container outlet fitting and a probe mounted in the body, the dispense head defining respective passageways for gas and liquid, the probe being keyed for axial and rotational movement to a manually rotatable member mounted for rotation relative to the body, cam means being provided between the manually rotatable member and the body to cause the member and the probe to move axially and rotationally on manual rotation of the member, such movement of the probe being selectively manually operable independently of the action of attaching the body to the container, and a gas shut off valve being provided in the gas passageway adapted to close the passageway when the probe is in the withdrawn condition and to open it when the probe is in the extended position, said gas passageway being defined between the exterior of the probe and a conical counterbore formed in the interior of the body, the probe having an annular groove defined in its exterior and surrounding the probe, and said gas shut off valve comprising an O-ring provided in said groove and co-operable in the withdrawn position of the probe with the interior surface of the counterbore to close the gas passageway and spaced from the interior surface of the counterbore in the extended position of the probe.

* * * * *